United States Patent [19]

Connolly

[11] 4,453,328

[45] Jun. 12, 1984

[54] BUMPER STICKER HOLDER

[76] Inventor: Jack Connolly, 1647 Loganberry Way, Pleasanton, Calif. 94566

[21] Appl. No.: 453,782

[22] Filed: Dec. 27, 1982

[51] Int. Cl.[3] ..... G09F 21/04; G09F 7/12

[52] U.S. Cl. ..... 40/591; 40/210; 40/590; 40/594

[58] Field of Search ..... 40/152, 591, 152.1, 40/156, 590, 594, 600, 592, 593, 200, 208, 209, 210, 207

[56] References Cited

U.S. PATENT DOCUMENTS

| | | | |
|---|---|---|---|
| 2,110,515 | 3/1938 | Weaver | 40/209 |
| 2,916,842 | 12/1959 | Mushynski | 40/209 |
| 2,969,605 | 1/1961 | Garvin | 40/600 |
| 3,141,253 | 7/1964 | Bartram | 40/593 |
| 3,173,219 | 3/1965 | Yarder | 40/152 |
| 3,393,891 | 7/1968 | Murray | 40/200 |
| 3,908,296 | 9/1975 | Harrison | 40/210 |
| 3,918,187 | 11/1975 | Vogele | 40/152.1 |
| 4,270,287 | 6/1981 | Gimbel | 40/156 |

*Primary Examiner*—Gene Mancene
*Assistant Examiner*—James Hakomaki
*Attorney, Agent, or Firm*—Alvin E. Hendricson

[57] ABSTRACT

A bumper sticker holder for automobiles and the like has a mounting element adapted for attachment to a bumper by adhesive and mounting a holder element in adjustable pivotal position for receiving and retaining bumper sticker or signs with a transparent front face exposing the contents.

3 Claims, 4 Drawing Figures

FIG _ 1
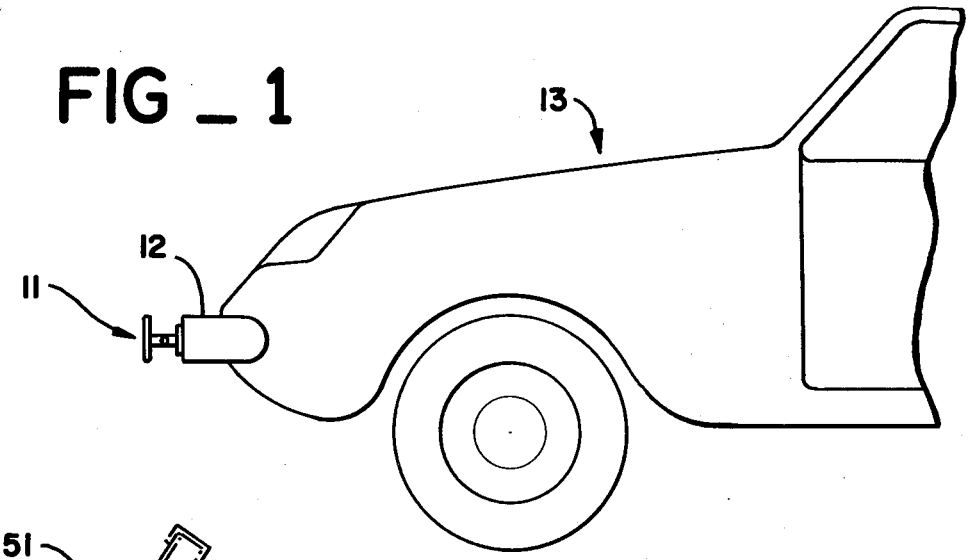
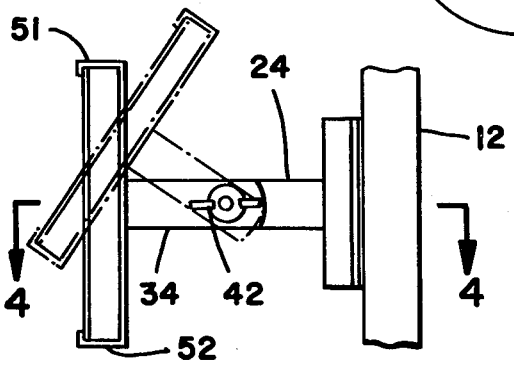
FIG _ 3
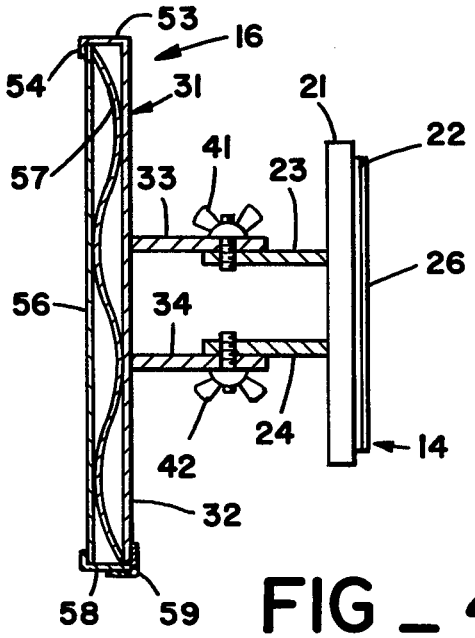
FIG _ 4
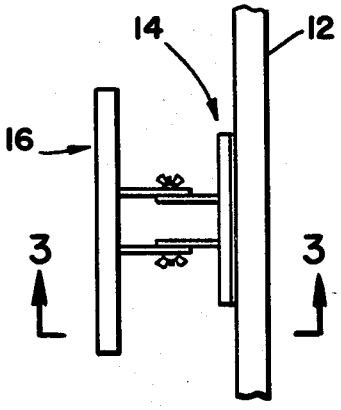
FIG _ 2

BUMPER STICKER HOLDER

BACKGROUND OF INVENTION

It is known that so called "bumper stickers" are widely disseminated with a wide variety of printed legends thereon ranging from sincere advocation of a cause, person or organization to humorous comments about timely subjects. Such stickers are normally provided as a printed strip with an adhesive backing covered by a tear strip or removable sheet and they are adapted to be adhered to the bumper of a vehicle.

It has been recognized that bumper stickers are much easier to apply than to remove, inasmuch as the quality of adhesive employed to defeat the elements of nature also normally defeat the efforts of complete removal. These stickers are only applied to bumpers because the necessary qualities of adhesives employed for interior use would damage painted surfaces. This has led to various "improvements" or modifications intended to adapt the removable application of printed material to the exterior of automobiles. Note in this respect U.S. Pat. No. 3,826,026 to Bevan. A related development in the mounting of printed material interiorly of an automobile is shown in U.S. Pat. No. 1,701,106.

Another of the problems of mounting bumper stickers is the visibility thereof. Automobiles have a wide variety of bumper configurations and some at least do not include flat surfaces directed horizontally forward or rearward of the vehicle. Thus a label or bumper sticker adhered to such a bumper may not be readily visible to other drivers or pedestrians.

SUMMARY OF INVENTION

The present invention provides a simply constructed bumper sticker holder adapted to removably receive a "bumper sticker" without use of the adhesive thereof and to protect such sticker from damage by the elements of nature so that it may be readily removed and retained as in a collection of such items. There is herein provided a two-element device with the first mounting element being adapted for adhesion to a bumper or the like and the second holder element being adapted for removably receiving and retaining a bumper sticker while enclosing same as a protection from the elements of nature. The holder element is secured to the mounting element in adjustable pivotal relation thereto for directing the message upon the bumper sticker toward those whom are expected to read same.

BRIEF DESCRIPTION OF FIGURES

The present invention is illustrated as to a preferred embodiment thereof in the accompanying drawings, wherein:

FIG. 1 is a partial illustration of an automobile with the present invention mounted on the bumper thereof, FIG. 2 is a plan view of the present invention mounted on a bumper, FIG. 3 is a transverse sectional view taken in the plane 3—3 of FIG. 2; and FIG. 4 is a longitudinal sectional view taken in the plane 4—4 of FIG. 3.

DESCRIPTION OF PREFERRED EMBODIMENT

The present invention is adapted to receive and retain a bumper sticker or the like without directly adhering the sticker to the bumper of an automobile. The bumper sticker holder 11 hereof is illustrated in FIG. 1 to be attached to a bumper 12 of an automobile 13. The present invention includes a mounting unit 14 and a holder unit 16 which are pivotally connected as described below.

The mounting unit 14 may be simply comprised as a plate 21 having an adhesive 22 on the back side thereof and a pair of spaced lugs or projections 23 and 24 extending from the front face thereof. The adhesive 22 may initially be covered by a waxed paper or the like 26 which may be peeled from the adhesive for use of the latter in attaching the mounting unit 14 to a bumper 12.

The holding unit of the present invention, as illustrated in FIGS. 3 and 4, for example, is formed as a rectangular frame or case 31 having a back wall 32 from which project a pair of lugs 33 and 34 spaced apart to fit over the mounting unit lugs 23 and 24. The lugs 33 and 34 of the holding unit 16 are provided with aligned lateral apertures therethrough adjacent the outer ends thereof and, similarly, the lugs 23 and 24 of the mounting unit 14 are provided with aligned lateral apertures therethrough adjacent the outer ends thereof. In the illustrated embodiment of the present invention the apertures in the lugs 23 and 24 are aligned with the apertures in the lugs 33 and 34 with bolts 41 and 42 extending through the lugs 33 and 34 into threaded engagement with the lugs 23 and 24 so as to secure the mounting unit 14 and holding unit 16 together in pivotally adjustable relationship. It will be seen that the holding unit may be pivoted around the center line of the wing nuts 41 and 42, as indicated in phantom in FIG. 3. This is particularly advantageous for installations wherein the surface of a bumper may be inclined from vertical.

Considering further the holding unit 16, it is noted that same includes a back plate 31 with forwardly extending top and bottom walls 51 and 52, respectively, and one vertical end wall 53 which all may be integrally formed with a front rim 54 adapted to retain within the unit a transparent front plate 56. This mounting unit 16 is adapted to removably receive and retain a bumper sticker 57 which is illustrated in FIG. 4 in some disarray merely to distinguish same from the structural members of the present invention. In actual practice and use of the present invention, bumper stickers are normally formed of a relatively stiff material and the horizontal thickness of the holding unit 16 of the present invention is made sufficiently small that the bumper sticker will, in fact, fit therein much in the manner of a picture within a picture frame.

The present invention provides means for inserting and removing bumper stickers 57 in the holder or holding unit 16 and to this end there is illustrated in FIG. 4 a vertical end wall 58 which is mounted on the back wall or plate 31 by a hinge 59 so that access to the interior of the holder may be readily accomplished merely by pivoting the end wall 58 outwardly on a hinge 59. Preferably a catch is provided for retaining the end wall 58 in closing relationship in the position illustrated and this may be readily accomplished in a variety of manners such as, for example, providing a small protuberance mating with an indentation.

There has been described above structural details of a preferred embodiment of the present invention and while these structural elements are in themselves quite simple, it is particularly noted that the present invention provides a markedly improved bumper sticker holder or the like wherein a bumper sticker 57 may be readily inserted and later removed from the holder mounted on the bumper, for example, of an automobile. Prior art problems of removing a bumper sticker from the bumper of an automobile are wholly precluded herein inasmuch as the adhesive on the back of the bumper sticker is not employed to attach the sticker to the bumper. Anyone who has applied a bumper sticker to the bumper of an automobile will recognize the difficulties in removing such a sticker because the adhesive necessarily employed on the back thereof to withstand the elements of weather almost precludes the complete removal of same from the bumper so that the bumper surface appears defaced.

In addition to the foregoing, it is noted that there are bumper stickers which have some importance beyond their intended use. Thus, for example, it is known that people collect bumper stickers much as they collect matchbook covers and the buttons of political candidates. Normally it is not possible to remove a bumper sticker from a bumper without destroying the sticker. The present invention, on the other hand, provides for complete protection of the sticker during its display and, furthermore, provides for directing the front face of the bumper sticker so that it will be readily viewed by other motorists or pedestrians. As noted above, the bumpers of automobiles vary in configuration and many modern automobiles have bumpers with the flat surfaces thereof inclined upwardly or downwardly with respect to vertical so that direct application of a bumper sticker thereto may preclude dissemination of the information thereon inasmuch as it is not readily viewed by those to whom it is directed. The present invention precludes this problem by providing a pivotal mounting, as described above, so that the bumper sticker may in fact serve its intended purpose.

The present invention has been described above with respect to a single preferred embodiment thereof; however, it will be appreciated by those skilled in the art that various modifications and variations are possible within the spirit and scope of the present invention and thus it is not intended to limit this invention to the precise terms of description or details of illustration.

What is claimed is:

1. A bumper sticker holder comprising a mounting unit including a rigid plate with an adhesive upon a back surface thereof and at least one apertured lug projecting from a front face thereof, and a holding unit having a rigid back plate and transparent front plate defining a compartment for receiving a bumper sticker through an openable end thereof and at least one apertured lug projecting from the rear of said back plate for engaging the lug on said mounting unit with connecting means extending through the apertures in said lugs for pivotally mounting said holding unit on said mounting unit.

2. The bumper sticker holder of claim 1 further defined by said mounting unit having two spaced projecting apertured lugs on said front face thereof, said holding unit having two apertured lugs projecting from the rear of said back plate spaced apart to fit alongside the lugs on said holding unit with apertures in adjacent lugs in alignment, and said connecting means extending through apertures in said lugs comprising a pair of bolts extending through aligned lug apertures and threaded into one of each of said adjacent lugs for tightening to fix the holding unit in predetermined pivoted position relative to said mounting unit.

3. The bumper sticker holder of claim 1 further defined by said holding unit having a fixed top, bottom and first end wall defining with said back plate and transparent front plate said compartment for receiving a bumper sticker, and a second end wall pivotally mounted on said back plate for access to said compartment to insert and remove bumper stickers.

* * * * *